US009342006B2

(12) United States Patent
Gon

(10) Patent No.: US 9,342,006 B2
(45) Date of Patent: May 17, 2016

(54) BELT MEMBER, FIXING DEVICE, AND IMAGE FORMING APPARATUS INCLUDING THE SAME

(71) Applicant: KYOCERA Document Solutions Inc., Osaka (JP)

(72) Inventor: Shoko Gon, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/618,400

(22) Filed: Feb. 10, 2015

(65) Prior Publication Data

US 2015/0234331 A1 Aug. 20, 2015

(30) Foreign Application Priority Data

Feb. 17, 2014 (JP) ..... 2014-027226

(51) Int. Cl.
*G03G 15/20* (2006.01)

(52) U.S. Cl.
CPC ..... *G03G 15/2057* (2013.01)

(58) Field of Classification Search
CPC ..... G03G 15/2057; G03G 2215/2016
See application file for complete search history.

(56) References Cited

U.S. PATENT DOCUMENTS

| | | | | |
|---|---|---|---|---|
| 7,010,256 | B2 * | 3/2006 | Usui et al. | 399/328 |
| 2005/0286938 | A1 * | 12/2005 | Aze et al. | 399/328 |
| 2008/0145116 | A1 | 6/2008 | Tamemasa et al. | |

FOREIGN PATENT DOCUMENTS

| | | |
|---|---|---|
| JP | 2003-007438 | 1/2003 |

* cited by examiner

*Primary Examiner* — Sandra Brase
(74) *Attorney, Agent, or Firm* — Wenderoth, Lind & Ponack, L.L.P.

(57) ABSTRACT

Provided is a belt member used in a fixing device of an electromagnetic induction heating system. The belt member includes an endless resin base layer, heat layers, and an insulating resin layer. The heat layers are two or more layers including a non-magnetic metal stacked on the resin base layer. The insulating resin layer is an insulating layer stacked between the heating layers.

5 Claims, 6 Drawing Sheets

BELT MEMBER, FIXING DEVICE, AND IMAGE FORMING APPARATUS INCLUDING THE SAME

CROSS-REFERENCE TO RELATED APPLICATION

This application is based upon and claims the benefit of priority from Japanese Patent Application No. 2014-027226 filed on Feb. 17, 2014, the entire contents of which are incorporated herein by reference.

BACKGROUND

The technology of the present disclosure relates to a belt member, a fixing device, and an image forming apparatus including the same, and more particularly, to a belt member used in a fixing device of an electromagnetic induction heating system, a fixing device, and an image forming apparatus including the same.

In an image forming apparatus, a toner image formed on an image carrying member such as a photosensitive drum is transferred to a recording medium, the recording medium carrying the toner image is conveyed toward a fixing device, and the fixing device applies heat and pressure, so that an unfixed toner image on the recording medium is fixed to the recording medium. A fixing device includes electromagnetic induction heating system comprising a fixing roller, a belt member disposed on an outer peripheral surface of the fixing roller, a pressing roller brought into press contacted with the belt member, wherein an induction heating unit disposed facing the belt member to heat the belt member, and a toner image is fixed to the recording medium while the recording medium passes through a fixing nip portion between the belt member and the pressing roller.

According to the fixing device of the electromagnetic induction heating system, an eddy current is generated by magnetic flux generated by the induction heating unit to a heating layer provided in the belt member, the heating layer generates heat by the Joule heat generated by the eddy current, and the belt member is heated to a predetermined fixing temperature. In this type of fixing device, since the heat capacity of the heating layer can be reduced, a warm-up time for starting to operate the device can be shortened, so that a compact sized fixing device as well as high heat conversion efficiency can be obtained.

As the fixing device of the electromagnetic induction heating system, there have been known a uniaxial fixing device in which only a fixing roller is disposed on the inner peripheral surface of the belt member, and a multiaxial (biaxial) fixing device in which a fixing roller, a heat roller and the like are disposed on the inner peripheral surface of the belt member.

In the multiaxial (biaxial) fixing device, the fixing roller is provided at the outer peripheral surface thereof with an elastic layer, and forms a fixing nip portion. The heat roller thermally converts the magnetic flux generated by the induction heating unit and having passed through the belt member, thereby heating the belt member. As described above, although the magnetic flux generated by the induction heating unit has passed through the belt member, since the magnetic flux is thermally converted by the heat roller and the belt member is heated, it is possible to reduce power loss.

On the other hand, in the uniaxial fixing device, if the magnetic flux generated by the induction heating unit passes through the belt member, a cored bar of the fixing roller generates heat. However, since an elastic layer is formed on the outer peripheral surface side of the fixing roller, the fixing roller is not able to heat the belt member. Therefore, there is a case in which power loss occurs, and the temperature of the cored bar of the fixing roller is excessively raised, and thus the elastic layer is degraded and is broken. In addition, the uniaxial fixing device has a merit that it is possible to limit the entire heat capacity as compared with the multiaxial (biaxial) fixing device.

As the belt member used in the aforementioned fixing device of the electromagnetic induction heating system, various belt members have been known.

For example, there has been known a belt member (a first conventional structure) provided with a base layer (a thickness: 40 μm to 50 μm) including a magnetic metal such as Ni and an elastic layer and a release layer sequentially stacked on the base layer. In the belt member, the thickness of the base layer including a magnetic metal is limited to 40 μm to 50 μm, so that the bending performance of the belt member necessary for forming a fixing nip portion is maintained. However, since it is not possible to sufficiently ensure the thickness of the base layer with respect to the skin depth of the magnetic metal, leakage magnetic flux (magnetic flux passing through the belt member) is slightly generated, resulting in the degradation of heating performance.

In addition, the skin depth is a depth at which magnetic flux is converted into an eddy current and is attenuated to 1/e (e is the base of natural logarithms), wherein a skin depth $\delta[m]=1/\sqrt{(\pi f \mu \sigma)}$. f denotes a frequency [Hz], μ denotes permeability [H/m], and σ denotes conductivity [s/m]. The eddy current mainly flows through a thickness part equal to or less than the skin depth. Accordingly, when the thickness is equal to or more than the skin depth, the eddy current mainly flows in a range of the skin depth or less, and when the thickness is equal to or less than the skin depth, the eddy current flows in the whole thickness direction. In the magnetic metal, since the permeability is large and the skin depth is small, a resistance value at an obtained skin depth reaches a level suitable for the generation of an eddy current loss, so that high heating performance is obtained at a thickness equal to or more than the skin depth. On the other hand, in a non-magnetic metal, since the permeability is small and the skin depth is large, a resistance value at an obtained skin depth is too low, so that high heating performance is not obtained, but when the thickness is made smaller than the skin depth, a resistance value is increased, and heating performance indicates a peak at a predetermined thickness.

For example, as shown in the following Table 1, when a use frequency f of the induction heating unit is 20 kHz to 50 kHz, the skin depth of Ni (relative permeability $\mu r \approx 180$ and conductivity $\sigma=1.5E7$[s/m]) is around 50 μm, and has a value approximate to the thickness used in the belt member including Ni. On the other hand, the skin depth of Cu (relative permeability $\mu r \approx 1$ and conductivity $\sigma=5.8E7$[s/m]) is about 300 μm or more, and when the depth is equal to or less than about 300 μm, an eddy current flows in the whole thickness direction. An effective resistance value at this time is calculated as a reference value. The effective resistance value of Ni is 9.7E-4 to 1.5E-3, and the effective resistance value of Cu is 3.7E-5 to 5.8E-5. In addition, the effective resistance value [Ω] is defined as resistivity ρ [Ω·m]/thickness [m]=1/(conductivity σ [s/m]×thickness [m]). The effective resistance value is an index proportional to a cross-sectional resistance value in a direction parallel to the thickness of the belt member.

TABLE 1

| | Frequency [kHz] | | | |
|---|---|---|---|---|
| | 20 | 30 | 50 | Note |
| Ni skin depth [μm] | 68 | 55 | 43 | |
| Cu skin depth [μm] | 480 | 380 | 290 | |
| Ni effective resistance value [Ω] | 9.7E−4 | 1.2E−3 | 1.5E−3 | Thickness = skin depth |
| Cu effective resistance value [Ω] | 3.7E−5 | 4.5E−5 | 5.8E−5 | Thickness = skin depth |
| Cu effective resistance value [Ω] | | 1.7E−3 | | Thickness = 10 μm |

In Table 1 above, the effective resistance values of Cu are calculated in two conditions in which the thickness is the skin depth and is 10 μm. When the effective resistance values at the skin depths are compared with each other, Cu is 1/10 or less with respect to Ni, and the thickness of Cu is thinned to about 10 μm, so that the effective resistance value of a Cu layer is increased to a level of the effective resistance value of the skin depth of a Ni layer. Referring to the effective resistance values of Table 1 above, it is considered that about 1 mΩ to about 2 mΩ are effective resistance value levels necessary for a heating member.

In the magnetic metal, the relation of the image diagram illustrated in FIG. 5 is established between the thickness and the heating performance, the leakage magnetic flux, and the effective resistance value. Accordingly, when the thickness is equal to or more the skin depth, since an eddy current mainly flows in a range of the skin depth, the heating performance is controlled at the skin depth.

On the other hand, in the non-magnetic metal, as in the image diagram illustrated in FIG. 6, the heating performance is easily dependent on the thickness. In the case of Cu, a heating peak is expressed by a thickness of about 5 μm to about 15 μm. Accordingly, the heating performance of the non-magnetic metal is controlled by the thickness in a range of the skin depth or less.

When a non-magnetic metal layer is used as an IH heating member, since it is used in a thickness equal to or less than a skin depth, leakage magnetic flux passing through a heating layer is generated to a certain degree. As a method for improving the heating performance and the leakage magnetic flux of the non-magnetic metal layer, a method for stacking the non-magnetic metal layer together with a magnetic metal layer has been known. For example, there has been known a belt member (a second convention structure) provided with a base layer (a thickness: 30 μm to 35 μm) including a magnetic metal such as Ni, a non-magnetic metal layer (a thickness: 5 μm to 15 μm) including Cu and the like and stacked on the base layer, and an anti-oxidation film, an elastic layer, and a release layer sequentially stacked on the non-magnetic metal layer. In this belt member, heat is generated by both the base layer including the magnetic metal and the non-magnetic metal layer. Since the base layer has a smaller thickness as compared with the base layer of the first convention structure, the heating performance is slightly degraded. However, since the non-magnetic metal layer has the same heating performance as that of the base layer of the first convention structure, it is possible to improve the heating performance in the second convention structure, as compared with the first convention structure.

In the case of a belt member using a metal base layer, it is preferable that the total thickness of a metal layer is about 50 μm or more in terms of heating performance. On the other hand, in terms of bending performance, it is preferable that the total thickness of the metal layer is about 50 μm or less. In the present circumstances, in order to balance these two performance, a belt member in which the total thickness of the metal layer is about 40 μm to about 50 μm is mainly used. However, there has also been a demand for further improving the bending performance of the belt member.

Therefore, for example, there has been proposed a belt member (a third convention structure) provided with a base layer (a thickness: 50 μm to 100 μm) including an insulating resin such as polyimide, a non-magnetic metal layer (a thickness: 5 μm to 15 μm) including Cu and the like and stacked on the base layer, and an anti-oxidation film, an elastic layer, and a release layer sequentially stacked on the non-magnetic metal layer. In this belt member, the base layer is made of an insulating resin and the thickness of the metal layer is limited, so that it is possible to improve the bending performance.

In addition, there has been proposed a fixing belt (a belt member) provided with a base layer including a metal, a heating layer stacked on the base layer and including a metal, and a surface release layer stacked on the heating layer. Furthermore, there has been proposed a fixing belt (a belt member) in which a plurality of non-magnetic metal layers sequentially stacked are included and the total thickness of the non-magnetic metal layers is 48 μm to 63 μm.

SUMMARY

In order to achieve the above object, a belt member according to one aspect of the present disclosure is a belt member used in a fixing device of an electromagnetic induction heating system and includes a resin base layer, heat layers, and an insulating resin layer. The resin base layer is endlessly formed. The heating layers are two or more layers stacked on the resin base layer and including a non-magnetic metal. The insulating resin layer is an insulating layer stacked between the heating layers.

DETAILED DESCRIPTION

Hereinafter, the present embodiments will be described with reference to the accompanying drawings.

(First Embodiment)

Figure 1:
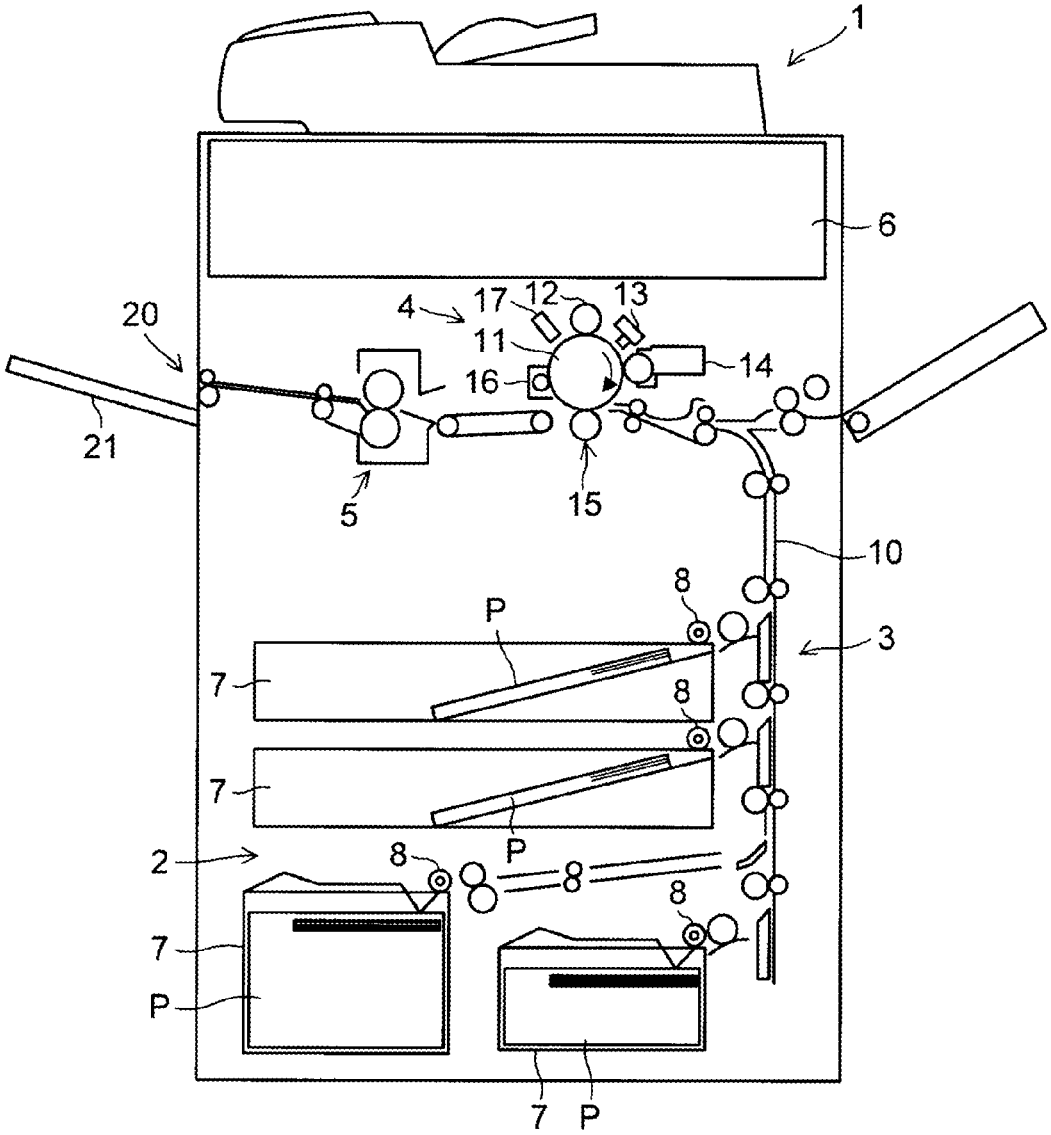
FIG. 1 is a sectional view schematically illustrating the entire structure of an image forming apparatus provided with a fixing device including a belt member according to a first embodiment.
Figure 2:
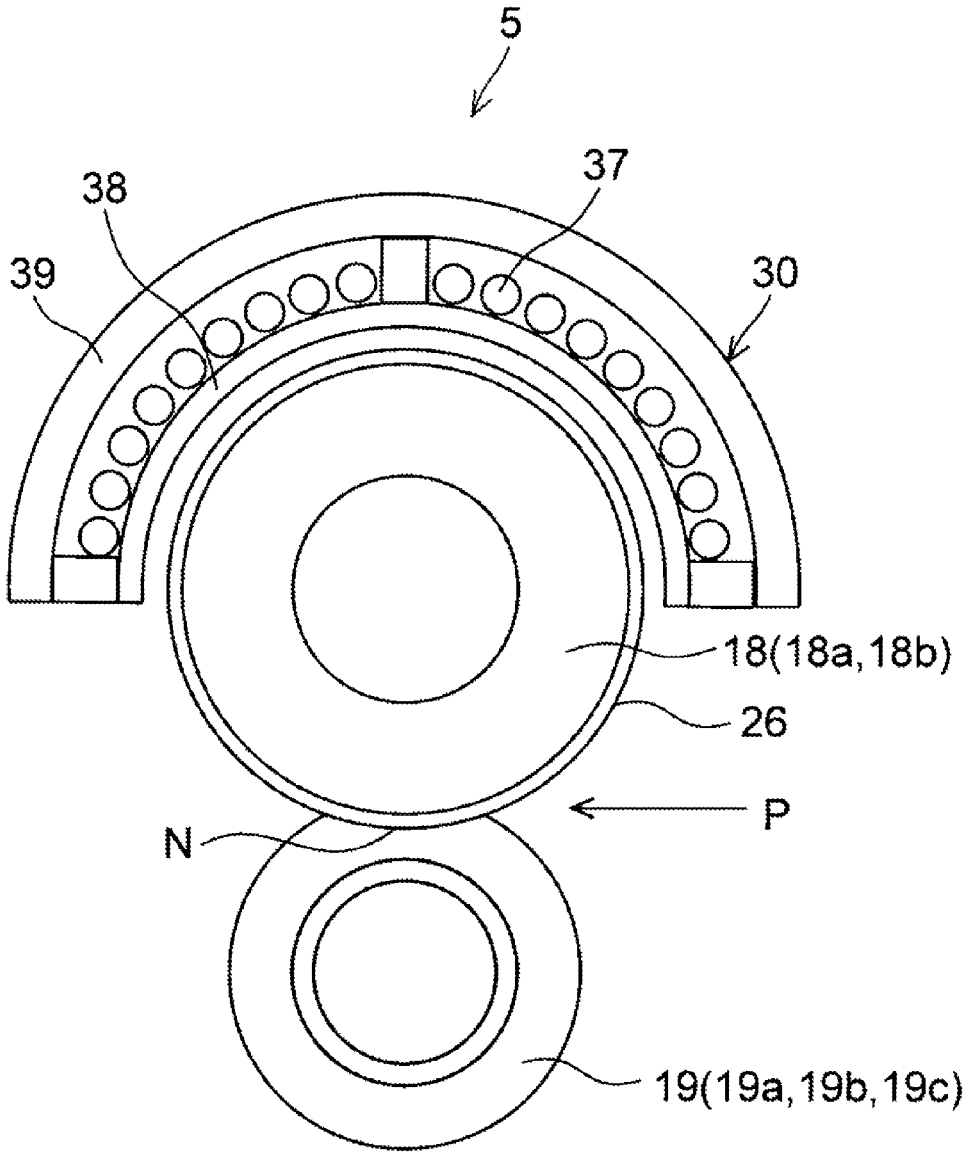
FIG. 2 is a sectional view illustrating the structure of a fixing device including a belt member of a first embodiment.
Figure 3:
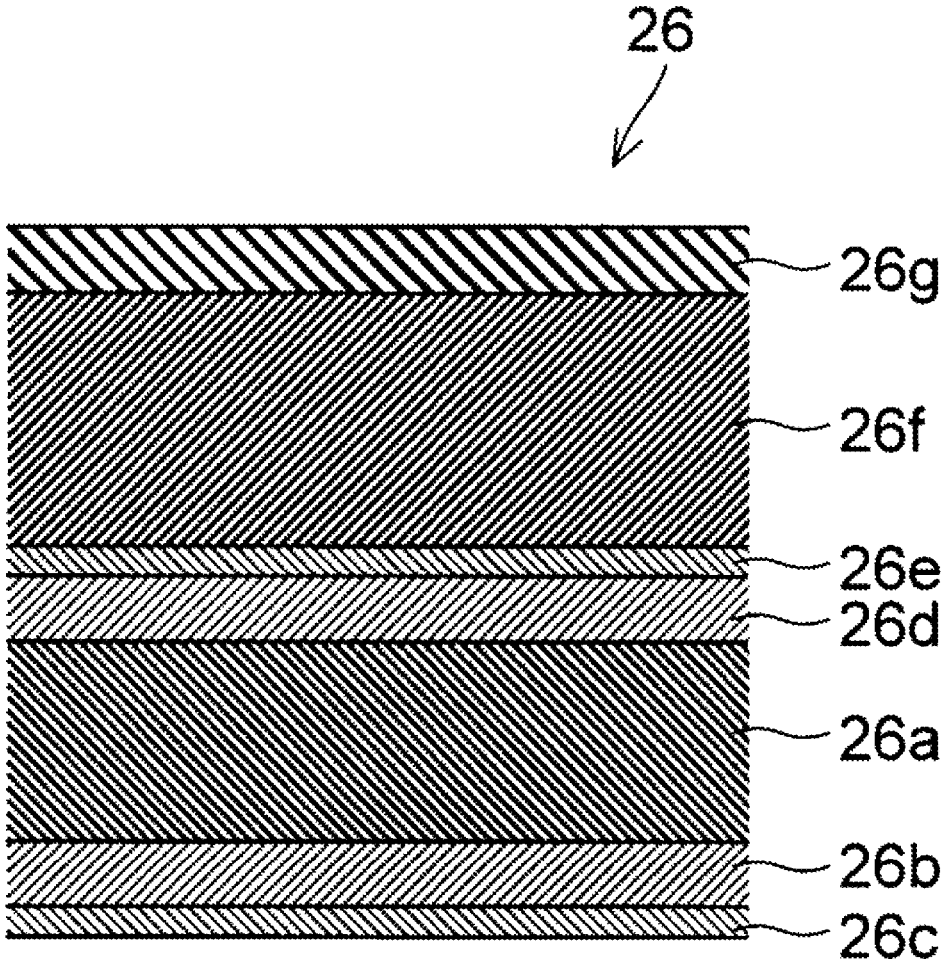
FIG. 3 is an expanded sectional view illustrating the structure of a belt member of a first embodiment.

With reference to FIG. 1 to FIG. 3, an image forming apparatus 1 according to a first embodiment will be described. The image forming apparatus 1 includes a sheet feeding unit 2 disposed at a lower portion of the image forming apparatus 1, a sheet conveying unit 3 disposed at a lateral side of the sheet feeding unit 2, an image forming unit 4 disposed above the sheet conveying unit 3, a fixing device 5 disposed at a sheet discharge side from the image forming unit 4, and an image reading unit 6 disposed above the image forming unit 4 and the fixing device 5.

The sheet feeding unit 2 is provided with a plurality of sheet feeding cassettes 7 that accommodate sheets P which are recording media, and sends the sheets P to the sheet conveying unit 3 one by one from a sheet feeding cassette 7 selected from the plurality of sheet feeding cassettes 7, by the rotation of a sheet feeding roller 8.

The sheet P sent to the sheet conveying unit 3 is conveyed toward the image forming unit 4 via a sheet conveying path 10 provided in the sheet conveying unit 3. The image forming unit 4 forms a toner image on the sheet P by an electrophotographic process, and includes a photoreceptor 11 supported rotationally in an arrow direction of FIG. 1, and a charging section 12, an exposure section 13, a developing section 14, a transfer section 15, a cleaning section 16, and an electricity removing section 17 around the photoreceptor 11 along the rotation direction of the photoreceptor 11.

The charging section 12 is provided with a charging roller to which a high voltage is applied, and when a predetermined potential is applied to the surface of the photoreceptor 11 from the charging roller contacting with the surface of the photoreceptor 11, the surface of the photoreceptor 11 is uniformly charged. Then, when light based on image data of a document read by the image reading unit 6 is irradiated onto the photoreceptor 11 from the exposure section 13, the surface potential of the photoreceptor 11 is selectively attenuated, so that an electrostatic latent image is formed on the surface of the photoreceptor 11.

The developing section 14 develops the electrostatic latent image on the surface of the photoreceptor 11, so that a toner image is formed on the surface of the photoreceptor 11. The toner image is transferred to the sheet P supplied between the photoreceptor 11 and the transfer section 15 by the transfer section 15.

The sheet P, to which the toner image has been transferred, is conveyed toward the fixing device 5 disposed at a downstream side of the sheet conveying direction of the image forming unit 4. In the fixing device 5, the sheet P is heated and pressed, so that the toner image is melted and fixed on the sheet P. Then, the sheet P, on which the toner image has been fixed, is discharged onto a discharge tray 21 by a discharge roller pair 20.

After the toner image is transferred to the sheet P by the transfer section 15, a toner remaining on the surface of the photoreceptor 11 is removed by the cleaning section 16, and a residual electric charge on the surface of the photoreceptor 11 is removed by the electricity removing section 17. Then, the photoreceptor 11 is charged again by the charging section 12, and image formation is performed in the same manner.

Figure 5:
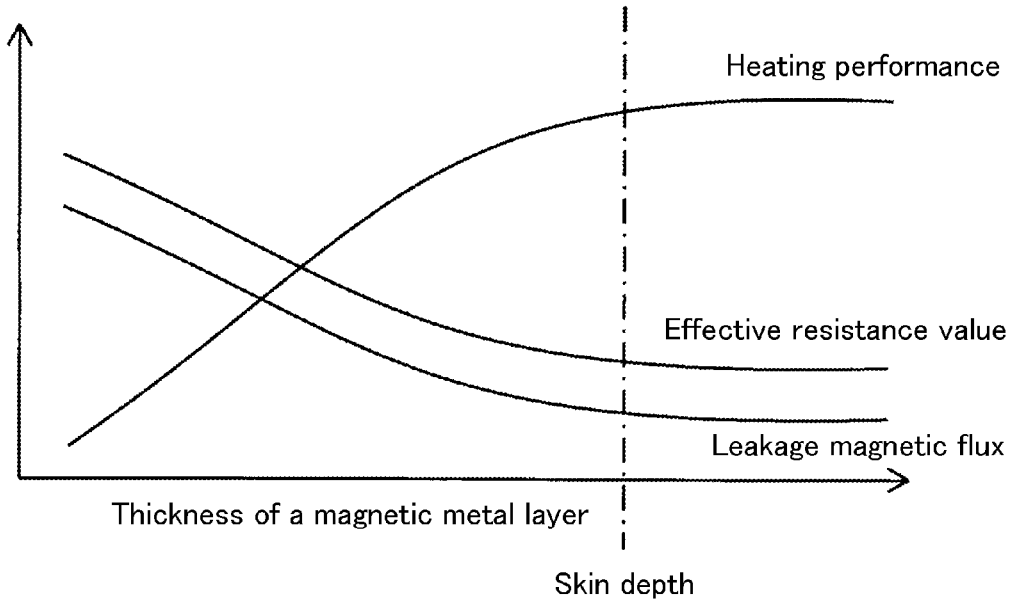
FIG. 5 is an image diagram illustrating a relation between a thickness of a magnetic metal layer and an effective resistance value, heating performance, and leakage magnetic flux.
Figure 6:
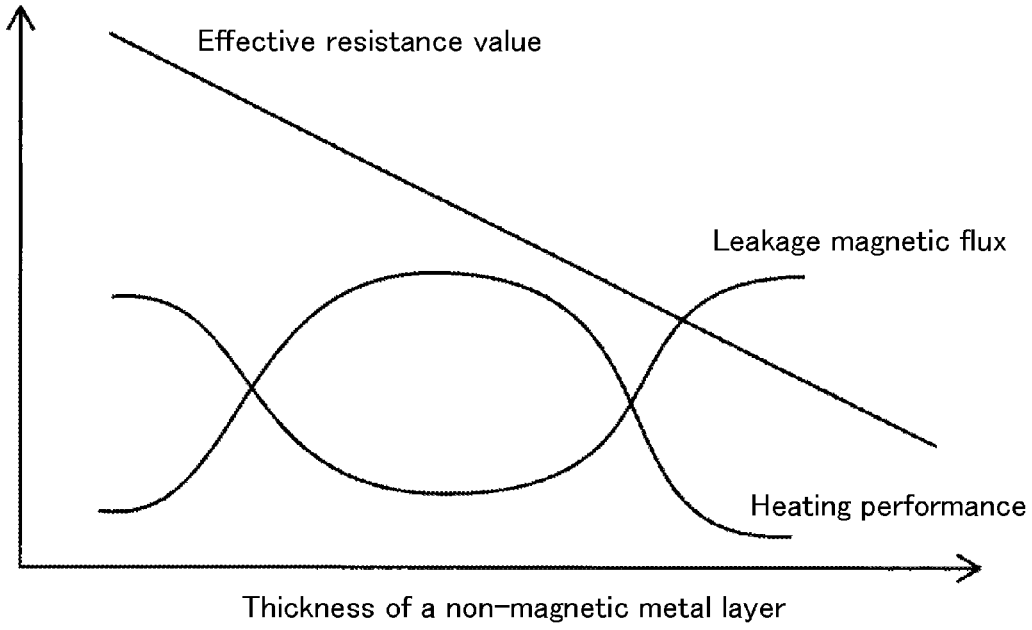
FIG. 6 is an image diagram illustrating a relation between a thickness of a non-magnetic metal layer and an effective resistance value, heating performance, and leakage magnetic flux.

Next, a detailed structure of the fixing device 5 will be described. As illustrated in FIG. 5, the fixing device 5 uses the electromagnetic induction heating system, and includes an endless belt member 26 serving as a heating member, a fixing roller 18 disposed on an inner peripheral surface of the belt member 26, a pressing roller 19 serving as a pressing member, and an induction heating unit 30 for supplying magnetic flux to the belt member 26.

In order to be rotatable together with the belt member 26, the fixing roller 18 stretches the inner peripheral surface of the belt member 26. For example, the fixing roller 18 has an elastic layer 18*b* made of adiabatic silicone rubber having a thickness of 8 mm to 10 mm on a cored bar 18*a* including aluminum, non-magnetic SUS and the like, wherein the elastic layer 18*b* stretches the belt member 26.

The pressing roller 19, for example, has an outer diameter set to 30 mm to 35 mm, and has an elastic layer 19*b* made of foamed silicone rubber having a thickness of 2 mm to 5 mm on a cored bar 19*a* including cylindrical aluminum and the like and a release layer 19*c* including a fluorine resin and the like on the elastic layer 19*b*. Furthermore, the pressing roller 19 is rotationally driven by a driving source such as a motor (not illustrated), and presses the fixing roller 18 in a center direction of the fixing roller 18. In this way, the pressing roller 19 and the fixing roller 18 are pressed via the belt member 26, so that the belt member 26 and the fixing roller 18 are driven and rotated by the rotation of the pressing roller 19. A nip portion N is formed at a part in which the pressing roller 19 and the belt member 26 are brought into press contact with each other, and in the nip portion N, an unfixed toner image on the conveyed sheet P is heated and pressed, so that the toner image is fixed on the sheet P.

The belt member 26, for example, is an endless heat resistant belt having an outer diameter set to 40 mm. Furthermore, as illustrated in FIG. 3, the belt member 26 includes a resin base layer 26*a* (an insulating resin layer), a first heating layer (a heating layer) 26*b* stacked on an inner peripheral surface of the resin base layer 26*a*, an anti-oxidation film 26*c* formed on an inner peripheral surface of the first heating layer 26*b*, a second heating layer (a heating layer) 26*d* stacked on an outer peripheral surface of the resin base layer 26*a*, and an anti-oxidation film 26*e*, an elastic layer 26*f*, and a release layer 26*g* sequentially stacked on an outer peripheral surface of the second heating layer 26*d*.

The resin base layer 26*a* includes an insulating resin of polyimide, polyamideimide and the like, and is formed to have a thickness of about 50 μm to about 100 μm. The first heating layer 26*b* includes a non-magnetic metal layer of Cu and the like, and is formed to have a thickness of about 5 μm to about 15 μm. The anti-oxidation film 26*c* is a layer for anti-oxidation of a Cu layer (the first heating layer 26*b*), includes Ni and the like, and is formed to have a thickness of about 1 μm to about 2 μm. The second heating layer 26*d* includes a non-magnetic metal layer of Cu and the like, and is formed to have a thickness of about 5 μm to about 15 μm. The anti-oxidation film 26*e* is a layer for anti-oxidation of a Cu layer (the second heating layer 26*d*), includes Ni and the like, and is formed to have a thickness of about 1 μm to about 2 μm. The elastic layer 26*f* includes silicone rubber and the like and is formed to have a thickness of about 100 μm to about 300 μm. The release layer 26*g* is a layer for improving releasability when an unfixed toner image is melt and fixed in the nip portion N, includes a fluorine resin of PFA, PTFE and the like, and is formed to have a thickness of about 20 μm to about 30 μm.

As a manufacturing method of the belt member 26, the endless resin base layer 26*a* including an insulating resin of polyimide, polyamideimide and the like is first prepared. The first heating layer 26*b* and the second heating layer 26*d* including a non-magnetic metal layer of Cu and the like are formed on the inner peripheral surface and the outer peripheral surface of the resin base layer 26*a*. At this time, an electrolytic plating method, an evaporation method, a sputtering method, a foil adhesion method and the like can be used. For example, in the case of forming a metal layer (a heating layer) on the resin base layer 26*a* by the electrolytic plating method, a conductive property is required in the resin base layer 26*a*. Therefore, before Cu and the like are electrolytically plated on the resin base layer 26*a*, a thin film of Ni layer, for example, is formed by an electroless plating method as a conductive layer, and a conductive property is imparted to the surface of the resin base layer 26*a*, so that it is possible to form a Cu layer and the like by the electrolytic plating method. Furthermore, the thin film metal layer (the Ni layer and the like) between the resin base layer 26*a* and the Cu layer also contributes to ensuring an adherence property between the resin base layer 26*a* and the Cu layer. In addition, when the electrolytic plating method is used, it is possible to simultaneously form the first heating layer 26*b* and the second heating layer 26*d* with the same thickness.

Next, the anti-oxidation films 26*c* and 26*e* including Ni and the like are formed on the surfaces of the first heating layer 26*b* and the second heating layer 26*d* by the electrolytic plating method and the like. Then, the elastic layer 26*f* including silicone rubber and the like is formed on the outer peripheral surface of the anti-oxidation film 26*e*. Finally, the release layer 26*g* including a fluorine resin of PFA, PTFE and the like is formed on the outer peripheral surface of the elastic layer 26*f*. In this way, the belt member 26 is manufactured.

As illustrated in FIG. 2, the induction heating unit 30 includes a coil 37, a bobbin 38, and a magnetic substance core 39, and allows the belt member 26 to generate heat by electromagnetic induction. The induction heating unit 30 extends in a longitudinal direction (the front and rear direction of the plane of FIG. 2), and is disposed facing the belt member 26 so as to surround an approximately half of the outer periphery of the belt member 26.

The coil 37 is wound a plurality of times in a loop shape along the width direction (the front and rear direction of the plane of FIG. 2) of the belt member 26, and is mounted in the bobbin 38. Furthermore, the coil 37 is connected to a power source (not illustrated), and generates AC magnetic flux by a high frequency current (a frequency: for example, 20 kHz to 50 kHz) supplied from the power source. The magnetic flux from the coil 37 passes through the bobbin 38 or the magnetic substance core 39, is led in a direction parallel to the plane of FIG. 2, and passes through along the first heating layer 26*b* and the second heating layer 26*d* of the belt member 26. By a change in the AC strength of the magnetic flux passing through the first heating layer 26*b* and the second heating layer 26*d*, an eddy current is generated in the first heating layer 26*b* and the second heating layer 26*d*. When the eddy current flows through the first heating layer 26*b* and the second heating layer 26*d*, the Joule heat is generated by the electrical resistance of the first heating layer 26*b* and the second heating layer 26*d*, so that the belt member 26 generates heat (self-heating).

When the belt member 26 is heated and is raised to a predetermined temperature, the sheet P interposed in the nip portion N is heated and is pressed by the pressing roller 19, so that a toner in a powder state on the sheet P is melt and fixed on the sheet P. As described above, since the belt member 26 includes a thin material with high heat conductive property and has a small heat capacity, it is possible to perform warming-up of the fixing device 5 in a short time, so that image formation is quickly started.

In the present embodiment, as described above, the two heating layers (the first heating layer 26*b* and the second heating layer 26*d*) are provided, so that it is possible to sufficiently improve heating performance (sufficiently limit leakage magnetic flux). Furthermore, the first heating layer 26*b* and the second heating layer 26*d* are formed using a non-magnetic metal, so that it is possible to ensure heating performance with a smaller thickness as compared with the case in which the first heating layer 26*b* and the second heating layer 26*d* are formed using a magnetic metal. In this way, it is possible to obtain the belt member 26 in which bending performance and heating performance are compatible with each other.

Furthermore, the resin base layer 26*a* including an insulating resin is provided between the first heating layer 26*b* and the second heating layer 26*d*, so that it is possible to prevent a resistance value from being reduced by the electrical conduction of the first heating layer 26*b* and the second heating layer 26*d*, thereby preventing the heating performance of the first heating layer 26*b* and the second heating layer 26*d* from being reduced.

Furthermore, as described above, the first heating layer 26*b* and the second heating layer 26*d* are formed on the inner peripheral surface and the outer peripheral surface of the resin base layer 26*a*. In this way, for example, in the case of forming the first heating layer 26*b* and the second heating layer 26*d* by the electrolytic plating method, it is possible to simultaneously form the first heating layer 26*b* and the second heating layer 26*d* with the same thickness, so that it is possible to simplify a manufacturing process.

Furthermore, as described above, the elastic layer 26*f* and the release layer 26*g* are provided at the outer peripheral surface side of the belt member 26, so that it is possible to easily ensure superior fixing property.

(Second Embodiment)

Next, with reference to FIG. 4, a belt member 26 of a second embodiment will be described.

Figure 4:
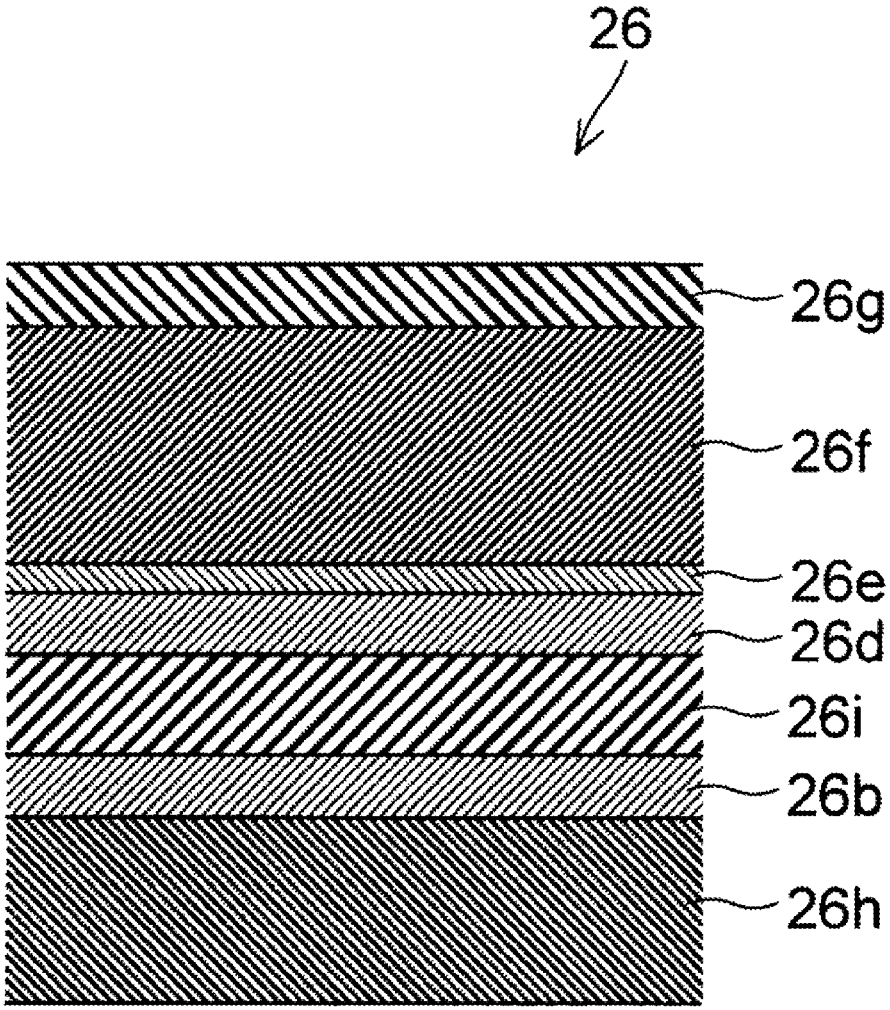
FIG. 4 is an expanded sectional view illustrating the structure of a belt member of a second embodiment.

In the second embodiment, as illustrated in FIG. 4, the belt member 26 includes a resin base layer 26*h*, a first heating layer 26*b* stacked on an outer peripheral surface of the resin base layer 26*h*, an insulating layer 26*i* (an insulating resin layer) formed on an outer peripheral surface of the first heating layer 26*b*, a second heating layer 26*d* formed on an outer peripheral surface of the insulating layer 26*i*, and an anti-oxidation film 26*e*, an elastic layer 26*f*, and a release layer 26*g* sequentially stacked on an outer peripheral surface of the second heating layer 26*d*.

The resin base layer 26*h* includes an insulating resin of polyimide, polyamideimide and the like, and is formed to have a thickness of about 50 μm to about 100 μm. The insulating layer 26*i* is a layer for electrically insulating the first heating layer 26*b* and the second heating layer 26*d* from each other, includes an insulating resin of polyimide, polyamideimide and the like, and is formed to have a thickness of about 10 μm to about 30 μm.

As a manufacturing method of the belt member 26, the endless resin base layer 26*h* including an insulating resin of polyimide, polyamideimide and the like is first prepared. The first heating layer 26*b* including a non-magnetic metal layer of Cu and the like is formed on the outer peripheral surface of the resin base layer 26*h*. Then, the insulating layer 26*i* including an insulating resin of polyimide, polyamideimide and the like is formed on the outer peripheral surface of the first heating layer 26*b*. At this time, a resin coating method, a film adhesion method and the like can be used. Thereafter, the second heating layer 26*d* including a non-magnetic metal layer of Cu and the like is formed on the outer peripheral surface of the insulating layer 26*i*.

Next, the anti-oxidation film 26*e* including Ni and the like, the elastic layer 26*f* including silicone rubber and the like, and the release layer 26*g* including a fluorine resin of PFA, PTFE and the like are sequentially formed on the outer peripheral surface of the second heating layer 26*d*. In this way, the belt member 26 is manufactured.

The other structures and manufacturing methods of the second embodiment are the same as those of the first embodiment.

In the present embodiment, as described above, the first heating layer 26*b*, the insulating layer 26*i*, and the second heating layer 26*d* are sequentially stacked on the outer peripheral surface of the resin base layer 26*h*. Also in this case, similarly to the belt member 26 of the first embodiment, it is possible to allow the bending performance and the heating performance of the belt member 26 to be compatible with each other.

The other effects of the second embodiment are the same as those of the first embodiment.

In addition, it should be considered that the embodiments disclosed this time are merely examples in all points and non-limiting. The technical scope of the present disclosure is defined not by the descriptions of the aforementioned embodiments but by the appended claims, and further, the technical scope of the present disclosure is intended to include meanings equivalent to the appended claims and all modifications within the technical scope of the present disclosure.

For example, an example, in which the technology of the present disclosure has been applied to a monochromatic image forming apparatus, has been described; however, the technology of the present disclosure is not limited thereto. It goes without saying that the technology of the present disclosure can also be applied to a color image forming apparatus.

Furthermore, in the above-mentioned embodiments, an example, in which the technology of the present disclosure has been applied to the uniaxial fixing device 5 including the belt member 26 stretched to the fixing roller 18, has been described; however, the technology of the present disclosure is not limited thereto. The technology of the present disclosure may also be applied to a fixing device including the pressing roller 19 brought into press contact with the outer peripheral surface of the belt member 26, and a pressing member disposed on the inner peripheral surface of the belt member 26 to allow the sheet P and the belt member 26 to be brought into press contact with each other, or a multiaxial (biaxial) fixing device in which the belt member 26 is suspended by the fixing roller 18, a heat roller and the like.

Furthermore, in the embodiments, an example, in which Cu is used as a non-magnetic metal for forming the first heating layer 26*b* and the second heating layer 26*d*, has been described; however, the technology of the present disclosure is not limited thereto. A non-magnetic metal of Al, Ag, non-magnetic SUS and the like may also be used.

Furthermore, in the embodiments, an example, in which the first heating layer 26*b* and the second heating layer 26*d* are formed by a non-magnetic metal layer, has been described; however, the technology of the present disclosure is not limited thereto. For example, a resin layer, to which a metal material is added by dispersion and the like of a non-magnetic metal filler, may also be used as a heating layer.

Furthermore, in the embodiments, an example, in which the anti-oxidation film, the elastic layer, and the release layer are provided in the belt member, has been described, but since these layers are provided according to necessity, they may not be provided.

Furthermore, in the embodiments, an example, in which the two heating layers (the first heating layer 26*b* and the second heating layer 26*d*) are provided in the belt member 26, has been described; however, the technology of the present disclosure is not limited thereto, and three or more heating layers may also be provided in the belt member 26. Also in this case, it is sufficient if an insulating resin layer is disposed between the heating layers in order to prevent the resistance values of the heating layers from being reduced.

Furthermore, configurations, which are obtained by appropriately combining the aforementioned embodiments and configurations of modifications with each other, are also included in the technical scope of the present disclosure.

What is claimed is:

1. A belt member used in a fixing device of an electromagnetic induction heating system, the belt member comprising:

two or more heating layers including a non-magnetic metal;

an endless insulating resin base layer stacked between the heating layers, the insulating resin base layer including polyimide or polyamideimide; and a plurality of anti-oxidation films, wherein a thickness of each of the heating layers is 5 μm or greater and 15 μm or less, and a thickness of the insulating resin base layer is 50 μm or greater and 100 μm or less, the two or more heating layers include a first heating layer and a second heating layer, the first heating layer and the second heating layer are formed on an inner peripheral surface and an outer peripheral surface of the insulating resin base layer, respectively, and the anti-oxidation films are stacked respectively on surfaces of the first and second heating layers that are opposite to an insulating resin base layer side.

2. The belt member of claim 1, further comprising:

an elastic layer and a release layer sequentially stacked at an outer peripheral surface side of the belt member.

3. A fixing device including the belt member of claim 1.

4. An image forming apparatus including the fixing device of claim 3.

5. The belt member of claim 1, wherein a number of the heating layers is two.

* * * * *